US008267572B2

(12) United States Patent
Windhab et al.

(10) Patent No.: US 8,267,572 B2
(45) Date of Patent: Sep. 18, 2012

(54) METHOD FOR GENTLE MECHANICAL GENERATION OF FINELY DISPERSED MICRO-/NANO-EMULSIONS WITH NARROW PARTICLE SIZE DISTRIBUTION AND DEVICE FOR CARRYING OUT SAID METHOD

(75) Inventors: Erich J. Windhab, Hemishofen (CH); Verena Schadler, Ede (NL); Beat Troxler, Rain (CH); Andreas Kurt Dürig, Visalia, CA (US); Fred-Rainer Grohmann, Urdorf (CH)

(73) Assignees: ETH-Zurich Institut fur Lebensmittelwissenschaft, Laboratorium fur Lebensmittelverfahren-Stechnik ETH-Zentrum/LFO, Zurich (CH); Kinematica AG, Littau (CH); Ion Bond AG, Olten (CH); Processtech GmbH, Hindelband (CH)

( * ) Notice: Subject to any disclaimer, the term of this patent is extended or adjusted under 35 U.S.C. 154(b) by 1208 days.

(21) Appl. No.: 11/574,152

(22) PCT Filed: Aug. 19, 2005

(86) PCT No.: PCT/EP2005/008980

§ 371 (c)(1), (2), (4) Date: Dec. 27, 2007

(87) PCT Pub. No.: WO2006/021375

PCT Pub. Date: Mar. 2, 2006

(65) Prior Publication Data

US 2011/0038901 A1 Feb. 17, 2011

(30) Foreign Application Priority Data

Aug. 23, 2004 (DE) ..... 10 2004 040 735

(51) Int. Cl.
*B01F 3/08* (2006.01)

(52) U.S. Cl. ..... 366/167.2; 366/169.1; 516/924; 516/929

(58) Field of Classification Search ..... 366/167.2, 366/169.1; 516/924, 928, 929
See application file for complete search history.

(56) References Cited

U.S. PATENT DOCUMENTS 5,326,484 A 7/1994 Nakashima et al.
6,177,479 B1 * 1/2001 Nakajima et al. ..... 516/73
(Continued)

FOREIGN PATENT DOCUMENTS

DE 10307568 A1 9/2004
EP 02095433 4/1990
(Continued)

*Primary Examiner* — David Sorkin
(74) *Attorney, Agent, or Firm* — Antonelli, Terry, Stout & Kraus, LLP.

(57) ABSTRACT

This invention relates to a method for the mechanically protective production of finely dispersed micro-/nanoemulsions with narrow droplet size distribution, whereby drops are produced on the surface of a membrane or of a filter fabric, and the drops are detached from the membrane or filter fabric surface by motion of the membrane or of the filter fabric in a first immiscible liquid phase in which pronounced stretching flow components in particular, besides shear flow components, bring about the detachment of the drops formed on the membrane surface especially efficiently and protectively. The invention also relates to a device for implementing the method according to the invention with a membrane or filter unit that is positioned to move, in particular to be able to rotate, in a housing with a gap that may be eccentric toward the inner wall of the housing and/or provided with flow baffles that produce stretching flow components.

20 Claims, 3 Drawing Sheets

U.S. PATENT DOCUMENTS

| | | | | |
|---|---|---|---|---|
| 6,576,023 | B2 * | 6/2003 | Nakajima et al. | 264/14 |
| 7,307,104 | B2 * | 12/2007 | Qiu et al. | 516/54 |
| 7,485,671 | B2 * | 2/2009 | Qiu et al. | 516/53 |
| 2003/0024878 | A1 | 2/2003 | Baltussen et al. | |
| 2004/0247768 | A1 * | 12/2004 | Angel | 426/629 |

FOREIGN PATENT DOCUMENTS

| | | | |
|---|---|---|---|
| EP | 02214537 | | 8/1990 |
| EP | 1262225 | A2 | 5/2002 |
| WO | WO 01/45830 | A1 | 6/2001 |
| WO | WO 2004/030799 | A1 | 4/2004 |

* cited by examiner 3
5

15
3
5

14
12
6
11
16
5
18
4
17
3

10
2
9
8
1
7
13

METHOD FOR GENTLE MECHANICAL GENERATION OF FINELY DISPERSED MICRO-/NANO-EMULSIONS WITH NARROW PARTICLE SIZE DISTRIBUTION AND DEVICE FOR CARRYING OUT SAID METHOD

BACKGROUND OF THE INVENTION

This invention relates to a method for mechanically protective production of finely dispersed micro-/nanoemulsions with a narrow droplet size distribution.

The invention also relates to a device for implementing the method.

The preparation of finely dispersed emulsions is an important development objective for the food, pharmaceutical, cosmetics, and chemical industries. The reason for this is the ability to keep such emulsions stable against settling with sufficiently small dispersed droplets, and to utilize the extremely large internal interface for the adsorption of functional ingredients (for example drugs, perfumes, pigments, etc.). The dispersed droplets also permit the buildup of particle networks that selectively influence the rheological properties of such emulsions.

Membrane emulsification methods are a new field for the manufacturers of machines and apparatus. Rotor/stator dispersing systems and high-pressure homogenization are ordinarily used for fine emulsification. Droplet dispersion in these apparatuses occurs under extremely high mechanical stress on both the dispersed and continuous phases. The membrane emulsification methods that have existed for about five years are very protective from the mechanical viewpoint compared to the conventional methods mentioned above, since the finely dispersed emulsion droplets are not produced by breaking apart larger drops, but are formed and released in their final size at the discharge orifices of the membrane pores.

In continuous membrane processes existing up to now, the continuous emulsion liquid phase flows tangentially over the membrane in the form of a pure shear flow. The shear stresses acting on the drops and detaching them from the membrane are not very efficient or not at all efficient with regard to detaching small drops and further dispersing (splitting) them, especially in case of high drop viscosities. This represents a considerable drawback with regard to the ability to adjust for small drop sizes and narrow droplet size distributions with the output capacities generally prescribed within narrow limits in the industrial production of emulsion systems.

DISCLOSURE OF THE INVENTION

The task underlying this invention is to provide a method for the mechanically protective production of finely dispersed micro-/nanoemulsions with narrow droplet size distribution.

The task underlying the invention is also to make available a device for implementing the method according to the invention.

This task is accomplished by a method for the mechanically protective production of finely dispersed micro-/nanoemulsions with narrow droplet size distribution, whereby drops are produced by a filter fabric unit or a membrane unit with pores in which a first liquid phase moves through these pores, and in particular is forced through them, and the drops are moved away (detached) from the filter fabric or membrane surface by their inherent motion in a second liquid phase immiscible with the first liquid phase while superimposed shear flow components and pronounced stretching flow components are produced in the gap between the membrane cylinder and the wall of the housing.

A stretching flow component superimposed on a tangential shear flow on the rotating membrane surface in the method according to the invention makes possible the protective detachment of smaller droplets, and their more efficient further dispersion after detachment takes place than is the case with pure shear flows.

In the method according to the invention, emulsion drops are produced on the surface of a membrane or a filter fabric permeated with pores, by a first fluid phase being pressed through these pores and by the drops being stripped from the membrane surface by its rotational motion in a second liquid phase immiscible with the first. Detachment of the liquid drops from the membrane surface is brought about by tangential and perpendicular stresses acting on them caused by the flow, assisted by additional centrifugal forces. The preferred use of membranes with definite large pore separations ($\geqq 2x$) compared to the pore diameter x is also necessary for producing a narrow droplet size distribution in the emulsion generated. The tangential flow over the membrane accomplished according to the invention with additionally efficient stretching flow components permits the production of distinctly smaller droplet diameters than conventional membrane emulsification methods with fixed or rotating membranes with pure shear flow over them, with comparable pore diameters. Compared to conventional emulsification methods by means of high-pressure homogenizers or rotating rotor/stator dispersing systems, producing emulsion droplets according to the invention offers the advantage of distinctly reduced mechanical stress for comparable diameters of the drops generated. This has advantages with respect to maintaining natural properties of functional components, for example of proteins in the drops or on their interfaces.

This task is also accomplished by a device for implementing the method, with a preferably rotationally symmetrical filter fabric and membrane unit movable around its longitudinal axis by a motor, which is positioned in a housing with a surrounding gap of variable gap width.

The device according to the invention permits simple modification and adaptation of the stretching flow-tangential flow characteristic of the membrane with respect to the fraction of stretching flow in the total flow, by varying the eccentricity of the rotating membrane cylinder and/or easily interchangeable flow baffles.

The device according to the invention is of very compact construction since the membrane unit can be placed in the housing closely spaced from its inner wall.

BRIEF DESCRIPTION OF THE DRAWINGS

Other features and advantages are found in the following description of the drawings in which the invention is illustrated by way of example. The drawings show:

FIG. 1A device according to the invention in longitudinal axial cross section, wherein the cut walls are not hatched, for simplification;

DETAILED DESCRIPTION OF THE DRAWINGS

Figures 1, 2, 3:
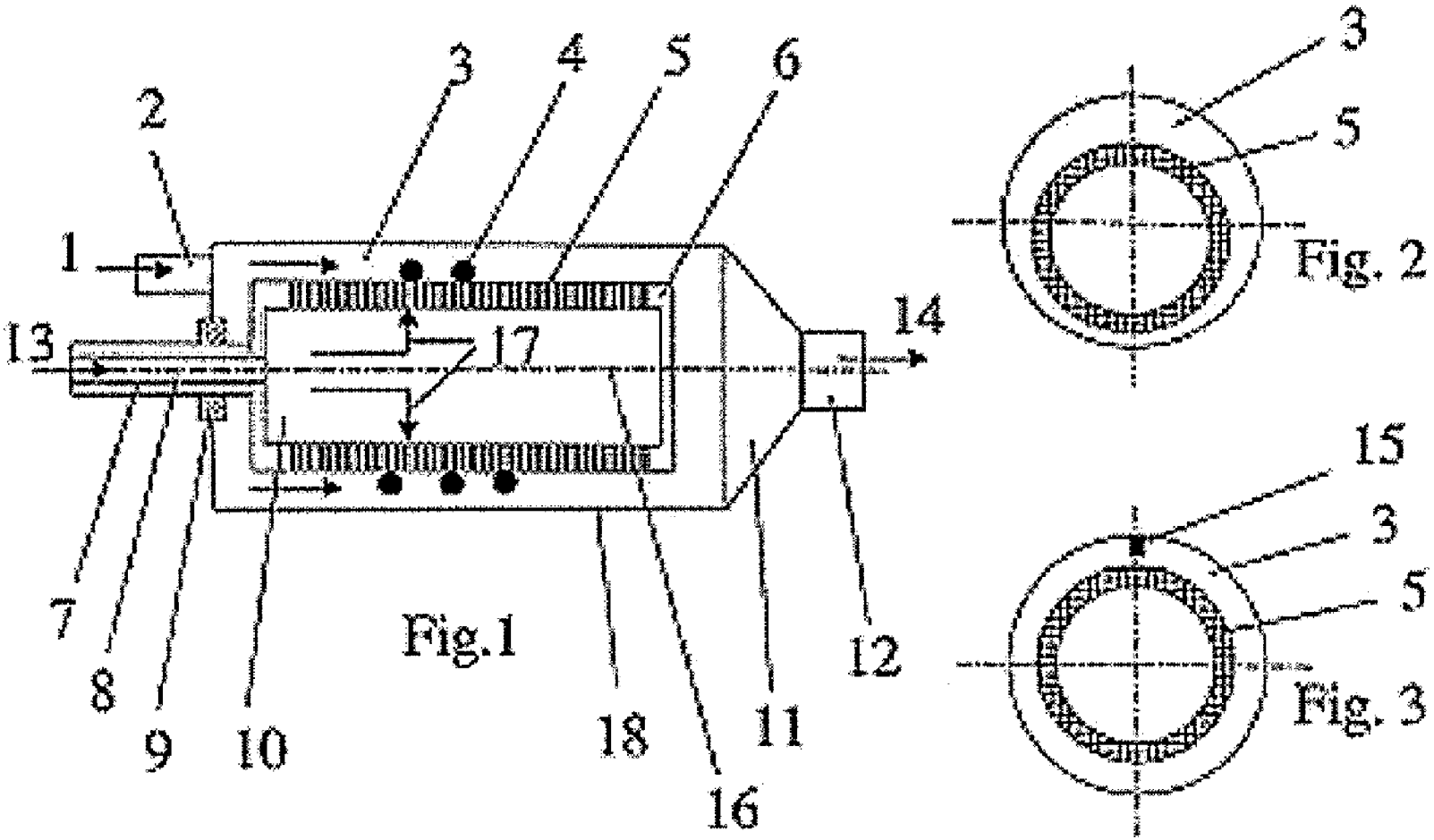
FIG. 2 a cross section of the device shown in FIG. 1 orthogonal to the longitudinal axis.
FIG. 3 likewise, a cross section of a device according to the invention orthogonal to the longitudinal axis, in another embodiment with flow baffles.

Reference symbol 1 designates a continuous liquid phase that is fed by pump from a suitable supply reservoir (not shown) to a connector 2 and through this to a gap 3.

Dispersed drops are labeled 4, and a membrane unit or filter fabric unit is labeled 5, while 6 identifies a cylindrical body made as a membrane cylinder.

7 is a rotating hollow shaft that has a bore 8 in its center. The shaft 7 is sealed off by a dynamic rotating mechanical seal 9.

The bore 8 opens into an internal space 10 in the filter fabric unit or the membrane unit 5.

A conical component is positioned at 11 that exits into an outflow port 12. The conical component 11 and the outflow port 12 constitute part of a housing 18.

A dispersion liquid phase is fed in at 13 by a motorized pump from a container, also not shown.

The emulsion 14 leaves the housing 18 through the outflow port 12.

In the embodiment shown in FIGS. 1 and 2, the filter fabric unit or membrane unit 5 is arranged eccentrically relative to the housing 18, with definite adjustable eccentricity.

In the embodiment according to FIG. 3, there is a flow baffle (for example the ridge 15) in the gap 3, which extends along the longitudinal axis 15 of the housing 18. The ridge 15 can also run helically, or can be part of a spiral. It is also possible to provide a number of such ridges 15, spirals, or helical ridges 3 with different cross sectional geometries inside the gap 3.

The diametrically opposite-pointing arrows 17 are intended to indicate the approximately radially oriented direction of flow of the dispersed liquid phase 13 with respect to the filter fabric unit or the membrane unit 5.

Figure 5:
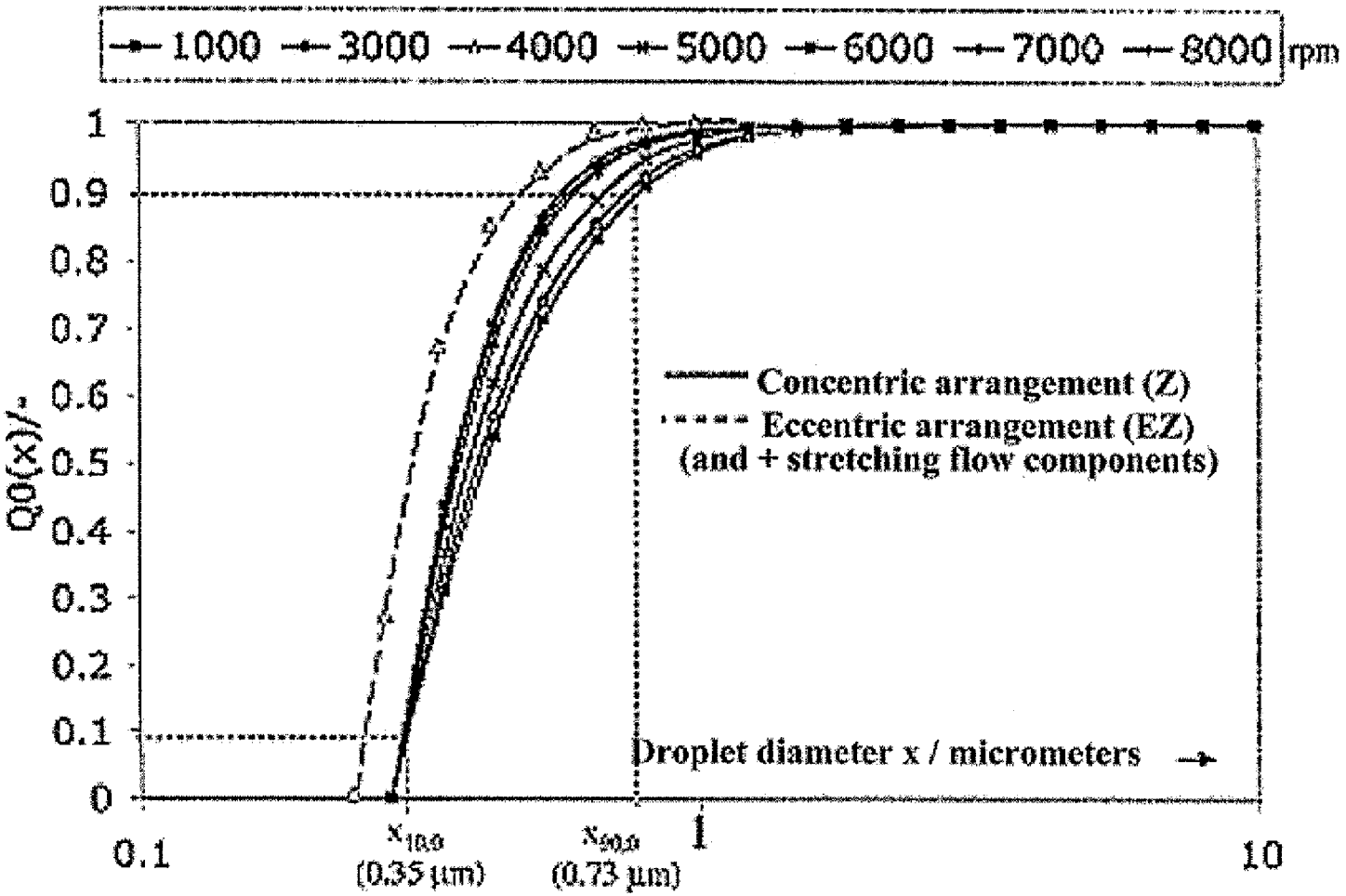
FIG. 5 a graphic illustration of the total number droplet distribution ($Q_0$ distribution) that was recorded for water droplets in sunflower oil with filter unit or membrane unit at speeds of 1000 to 8000 rpm (so-called $Q_0(x)$ distributions), plotting the characteristic droplet sizes $x_{90.0}$ and $x_{10.0}$, the ratio of which ($(x_{90.0}/x_{10.0})$ is used as a suitable measure of the spread of droplet size distribution, for concentric arrangement (Z) and eccentric arrangement (EZ).

FIG. 5 illustrates a corresponding total count distribution $Q_0(x)$ plotting the characteristic droplet sizes $X_{90.0}$ and $X_{10.0}$, the ratio of which $(x_{90.0}/x_{10.0})$ is used as a suitable measure of the breadth of droplet size distribution, showing representations for concentric positioning (Z) and eccentric positioning (EZ) (and/or with stretching flow components).

The way the embodiment shown in the drawing operates is as follows:

The dispersion liquid phase 13 is forced by the motor-driven pump, not shown, through the rotating hollow shaft 7 with an internal bore 8 into the interior chamber 10 of the rotating membrane cylinder unit 6. The shaft 7 is sealed off from the housing 18 by means of the rotating mechanical seal 9. From there, the dispersion liquid phase 13 passes through the membrane 5 attached on the surface of the cylinder body and forms the dispersed drops 4 on its outside.

The continuous liquid phase 1 is introduced through the connector 2 into the cylindrical housing 18, and flows axially through the gap 3 between the rotating membrane unit or filter fabric unit 5 and the housing 18. It impinges on the dispersed drops 4 formed on the membrane surface. The intensity of the impinging flow is determined by the circumferential velocity of the membrane unit or filter fabric unit and cylinder 6, the gap width 3, and the eccentricity, and flow baffles (such as ridge(s), pins, knives/scrapers) fastened to the outer cylinder wall between it and the housing 18.

If there is an eccentric positioning of the membrane cylinder 6 in the cylindrical housing 18 (FIG. 2) between the membrane cylinder 6 and the housing 18, a mixed shear/stretching flow occurs that has improved dispersing power. To produce improved drop detachment from the membrane surface, the flow baffles (e.g., ridge 15) that interfere specifically with the rotational flow can also be attached, preferably on the inner wall of the housing according to the invention. Such flow baffles (e.g., ridge 15) can be fitted either in a straight line with axial orientation, or helically.

The mixture of dispersed drops 4 and continuous liquid phase 1, the emulsion 14, is formed at the outlet from the gap 3 in an outlet geometry that preferably consists of a conical component 11 and an outlet port 12.

Figure 4:
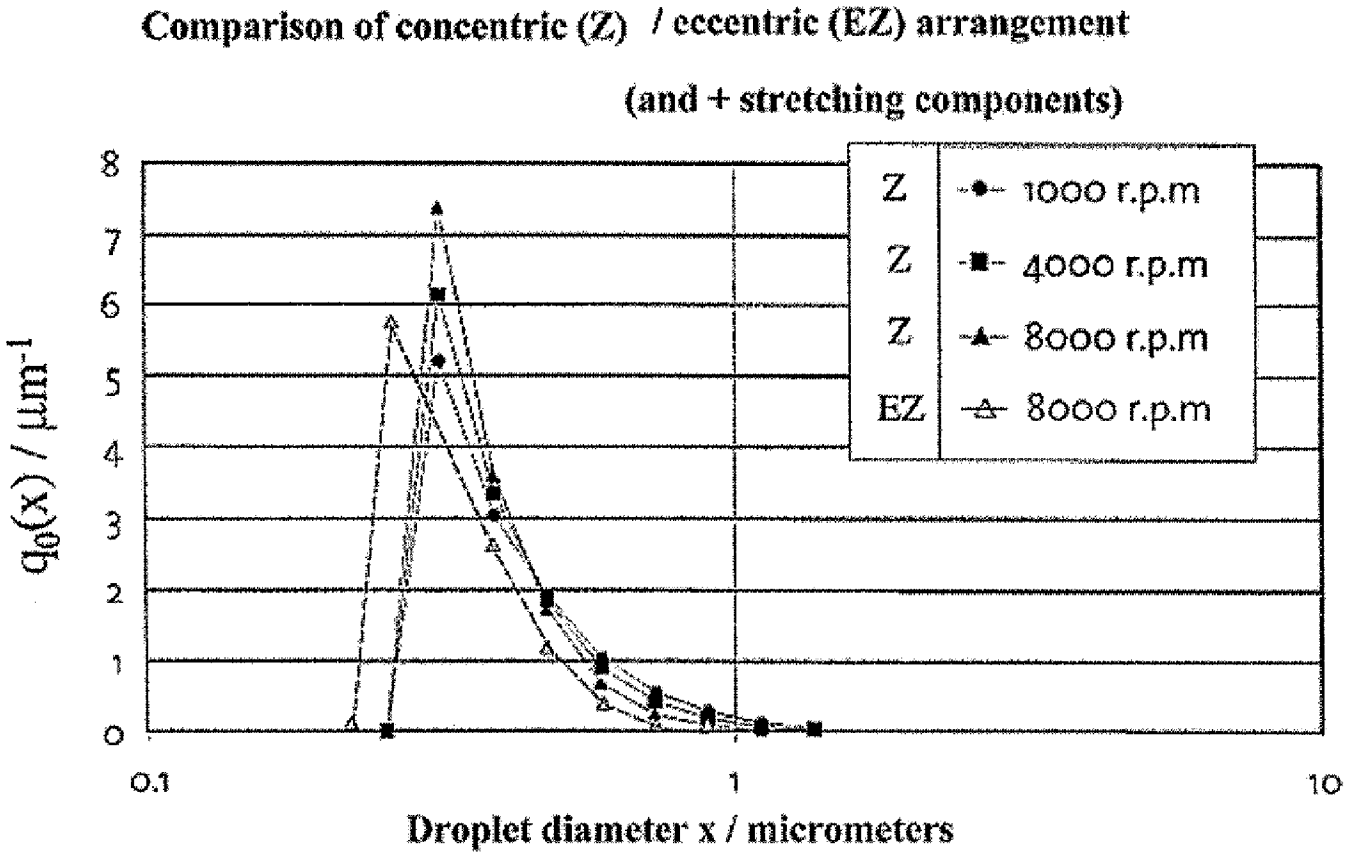
FIG. 4 a graphic illustration of the number density droplet distribution ($q_0$ distribution) that was recorded for water droplets in sunflower oil with filter unit or membrane unit at speeds of 1000 to 8000 rpm.

In FIG. 4, emulsions produced by means of a rotating membrane (CPDN membrane=Controlled Pore Distance Membrane) are illustrated graphically as a droplet size distribution function (number distribution qo(x)) in a comparison of pure shear flow (concentric cylinder) and superimposed stretching flow (eccentric cylinder).

The features described in the Abstract, in the Claims, and in the Specification, as well as features apparent from the drawing, may be important both individually and in any combination for realization of the invention.

LIST OF REFERENCE SYMBOLS

1 Liquid phase, continuous
2 Connector, connecting ports
3 Gap, annular gap, gap width
4 Drops, dispersed
5 Membrane, membrane unit, filter fabric unit
6 Cylinder body, membrane cylinder
7 Rotating shaft, shaft, hollow shaft
8 Bore, internal
9 Rotating mechanical seal, dynamic
10 Internal chamber
11 Component, conical
12 Outlet port
13 Liquid phase, dispersed
14 Emulsion
15 Ridge
16 Longitudinal axis
17 Double arrow
18 Housing

LITERATURE REFERENCES

DE 101 27 075 C2
WO 2004/030799 A1
WO 01/45830 A1
U.S. Pat. No. 5,326,484

The invention claimed is:

1. Method for the mechanically protective production of finely dispersed micro-/nanoemulsions with narrow droplet size distribution, comprising:

providing a rotating filter fabric unit or a membrane unit with pores within and spaced from an inner wall of a housing by a gap having a varying gap width;

forcing a first liquid phase from inside the rotating filter fabric unit or a membrane unit through the pores to the gap between the rotating filter fabric unit or membrane unit and the inner wall of the housing; and flowing a second liquid phase immiscible with the first liquid phase through the gap between the rotating filter fabric unit or membrane unit and the inner wall of the housing such that the drops of the first liquid phase are detached from an outer surface of the filter fabric or membrane unit by their inherent motion in the second liquid phase immiscible with the first liquid phase while superimposed shear flow components are produced by the flow of the second liquid phase and pronounced stretching flow components are produced in the gap due to the varying gap width.

2. Method according to claim 1, characterized in that the filter fabric unit or the membrane unit is rotated at an adjustable constant speed.

3. Method according to claim 1, characterized in that the filter fabric unit or the membrane unit is rotated at a periodically oscillating speed.

4. Method according to claim 1, characterized in that the first liquid phase flows through the filter fabric or membrane unit continuously.

5. Method according to claim 1, characterized in that before the first liquid phase flows through the filter fabric or membrane unit, the second liquid phase or another liquid immiscible with the first liquid phase briefly flows through the pores of the filter fabric or membrane unit in order to wet pore walls of the filter fabric or membrane unit to make them repellent to the first liquid phase.

6. Method according to claim 1, characterized in that the filter fabric or membrane unit is rotated at a speed that is not periodically variable according to a program stored in a computer.

7. Method according to claim 1, characterized in that the filter fabric or membrane unit is rotated eccentrically with respect to the inner wall of the housing for generating stretching flow components.

8. Method according to claim 7, characterized in that at least one ridge is provided in the gap for generating stretching flow components.

9. Method according to claim 1, characterized in that the first liquid phase flowing through the filter fabric or membrane unit is an emulsion, and thus a double emulsion of the water/oil/water or oil/water/oil type is formed in second liquid phase after the drops of the first liquid phase depart from the filter fabric or membrane unit.

10. Method according to claim 1, characterized in that the first liquid phase lowing through the filter fabric or membrane unit is a suspension, which forms a suspension/emulsion system in the second liquid phase after detachment of the drops from the filter fabric or membrane unit.

11. Method according to claim 1, characterized in that the first liquid phase flows through the filter fabric or membrane unit in pulses.

12. Method according to claim 1, characterized in that at least one ridge is provided in the gap for generating stretching flow components.

13. Method according to claim 12, characterized in that the at least one ridge extends in a longitudinal direction of the housing and of the filter fabric or membrane unit.

14. Method according to claim 13, characterized in that the at least one ridge has a straight form.

15. Method according to claim 13, characterized in that the at least one ridge has a helical form or a screw-like spiral form.

16. Method according to claim 12, characterized in that the ridge is provided on the inner wall of the housing.

17. Method according to claim 8, characterized in that the at least one ridge extends in a longitudinal direction of the housing and of the filter fabric or membrane unit.

18. Method according to claim 17, characterized in that the at least one ridge has a straight form.

19. Method according to claim 17, characterized in that the at least one ridge has a helical form or a screw-like spiral form.

20. Method according to claim 8, characterized in that the ridge is provided on the inner wall of the housing.

* * * * *